United States Patent [19]

Swenson

[11] 4,103,642

[45] Aug. 1, 1978

[54] REMOTE THREADING FLAGPOLE

[76] Inventor: Gordon Swenson, 310 Arbuckle Rd., Erie, Pa. 16509

[21] Appl. No.: 781,770

[22] Filed: Mar. 21, 1977

[51] Int. Cl.[2] ..... E21C 29/18; G09F 17/00

[52] U.S. Cl. ..... 116/174; 254/134.3 CL

[58] Field of Search ..... 116/173, 174; 254/134.3 CL; 52/720

[56] References Cited

U.S. PATENT DOCUMENTS

| | | | |
|---|---|---|---|
| 1,048,291 | 12/1912 | Buckley | 116/174 |
| 1,194,489 | 8/1916 | Earle | 116/174 |
| 2,507,623 | 5/1950 | Diaz | 116/174 |
| 2,530,654 | 11/1950 | Ellis | 116/173 |
| 3,300,185 | 1/1967 | Metzger et al. | 116/173 X |
| 3,556,483 | 1/1971 | Mantion | 254/134.3 CL |

*Primary Examiner*—Daniel M. Yasich

*Attorney, Agent, or Firm*—Charles L. Lovercheck

[57] ABSTRACT

A self-threading flagpole having two spaced pulleys fixed to a rotatable cap on its upper end and a slot connecting the outer periphery of the pulleys so that a rope in the form of a loop can be placed in the slot and over the pulleys by means of a pole without climbing the flagpole. The loop of rope passes over the periphery and down around the pulleys and down and around lower pulleys which are supported on a sleeve. The sleeve, in turn, is supported on the lower part of the flagpole by the rope and its weight provides tension on the ropes. When the wind blows the flag, the flag pulls the rope thereby lifting the sleeve and avoiding tearing of the flag.

10 Claims, 8 Drawing Figures

REMOTE THREADING FLAGPOLE

OBJECTS OF THE INVENTION

It is an object of the invention to provide an improved flagpole.

Another object of the invention is to provide a flagpole which is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
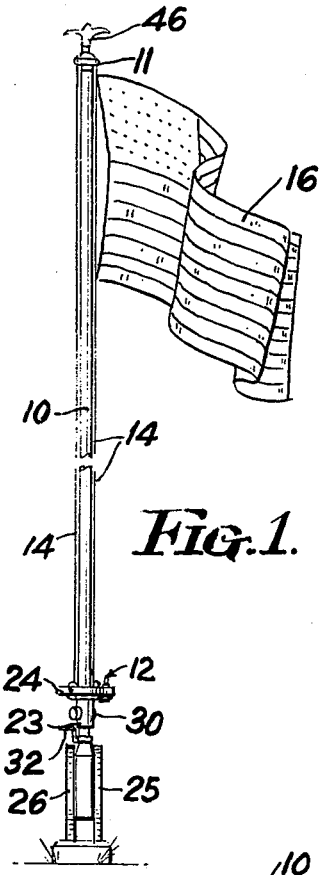
FIG. 1 is a view of the flagpole according to the invention showing a flag supported on it.

Now, with more particular reference to the drawing, the flagpole shown is generally indicated at 10 having the rotating cap 11 supported on the upper end of the flagpole. The bottom rope support sleeve means 12 is telescopically slidable on the lower part of the flagpole 10. The cap has spaced pulleys 13 supported on it which receive the upper part of the rope 14. Plates 15 and 16 are guide members for the rope which define a slot 17 which is about the same diameter as the rope 14. The slot extends from the top of cap 11 down to the periphery of pulleys 13 and enables a person to thread the pole by laying the rope on top of the inclined plate 15 and allowing the rope to slide down the plate 15 into the slot, to pass through and rest on the groove in pulleys 13.

The lower end of the bite or intermediate part of rope 14 passes down around the spaced pulleys 20 and 21 and around pulley 22. The rope should be sufficiently short so that the weights 30 on sleeve 23 of sleeve means 12 provide a sufficient tension on the rope so that a gentle breeze on flag 16 will not cause it to lift the sleeve 23 and pull the flag outwardly from the pole; but a strong wind will lift the sleeve and pull the flag outward.

The lever 28 is pivoted to the bottom of the flagpole by pin 31 and it has the handle 32 on it which may be grasped to swing lever 28 upward so that the lower end of sleeve 23 rests on top of sleeve 23, thereby relieving tension on rope 14 at the time it is desired to raise or lower the flag.

Pulley 22 has laterally extending spaced holes 34 in its side into which pin 35 may be inserted to maintain a relative position of the bite of the rope and to keep the flag in position. Pin 35 may extend through hole 36 in the flange 24 which is fixed to sleeve 23.

The lower end of the flagpole is swingably supported on support members 25 and 26 which may be imbedded in a suitable concrete anchor. Pin 27 extends to the lower end 29 of the flagpole and a suitable anchoring means can be provided to hold the flagpole in position.

Cap 11 has the thrust bearing 37′ held in place by a C washer 38 which is received in a groove in cap 11. The inner face of bearing 37′ is supported on the upper end 39 of stud 40 and clamped to the internally-threaded member 41 by nut 42 having a washer 43 resting against the inner end of the threaded cup 41. The flagpole 10 may be made of steel pipe of the like, or other suitable material having a pipe thread 44 on it which receives the female thread on cup 41. Pulleys 13 are rotatably supported on the cap by means of axles 45. The cap 11 has the downwardly extending skirt which overlies the upper end of cap 41. The ornament 46 can be held to the top of the cap by means of a suitable threaded member 47. Pulleys 20 and 21 are supported in slots 46 and 47 and are supported on axles 48 and 49. Pulley 22 is supported on an axle 50 and has the space hole 34 in it that receives the pin 35 which also may pass through the bore 36 in flange 24.

When it is desired to thread the flagpole, the loop of rope may be passed around pulleys 20 and 21 and around pulley 22. Sleeve 23 may then be moved upward and the arm 28 lifted so that the lower end of the sleeve rests on the stop 33 on handle 32. The upper end of the loop may be lifted by a suitable instrument, such as a pole lifting it over the pin 15 and the rope rested on top of pin 15.

Figure 2:
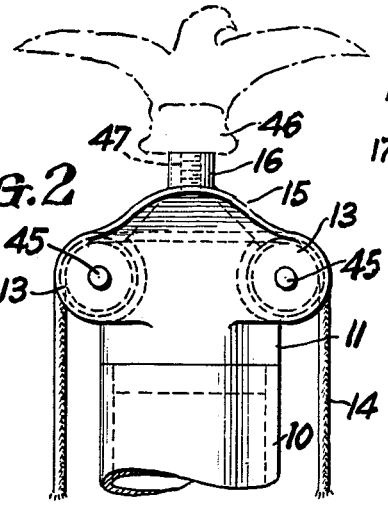
FIG. 2 is an enlarged partial view showing the upper part of the flagpole.
Figure 4:
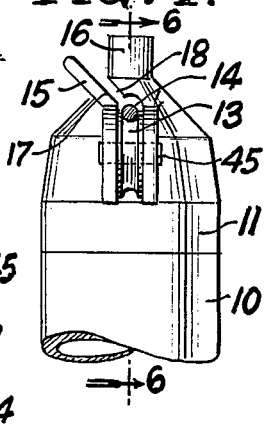
FIG. 4 is a side view of the part of the flagpole shown in FIG. 2.
Figure 5:
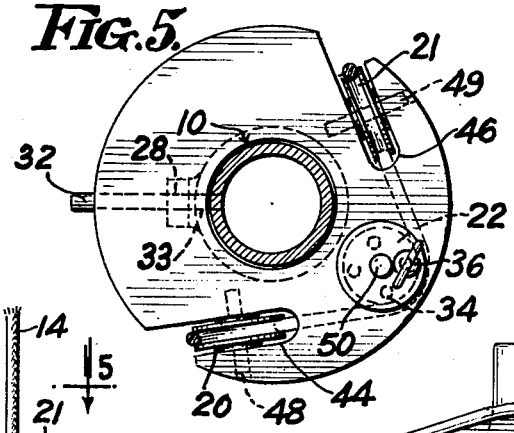
FIG. 5 is a cross-sectional view taken on line 5—5 of FIG. 3.
Figure 8:
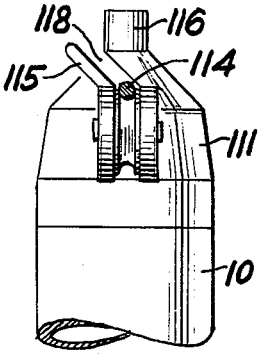
FIG. 8 is a view similar to FIG. 4 of another embodiment of the invention.
Figure 3:
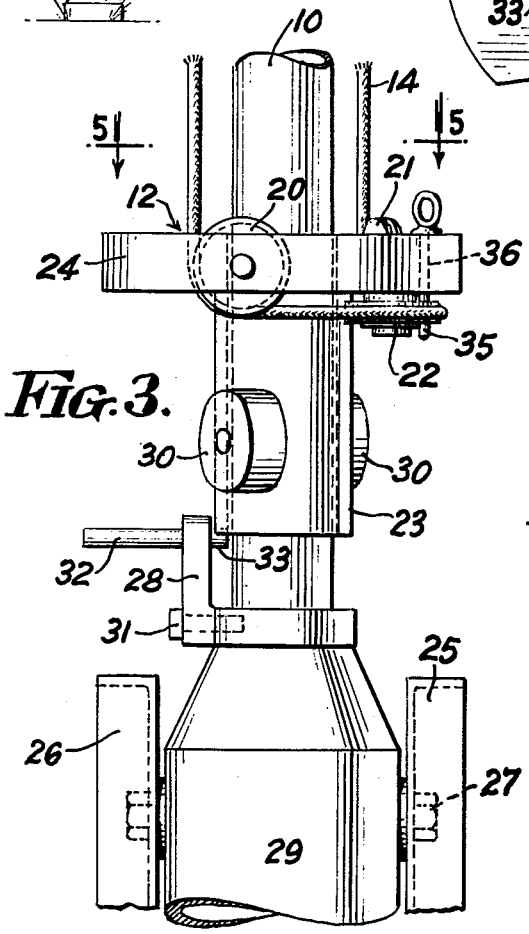
FIG. 3 is an enlarged part of the bottom of the flagpole.
Figure 6:
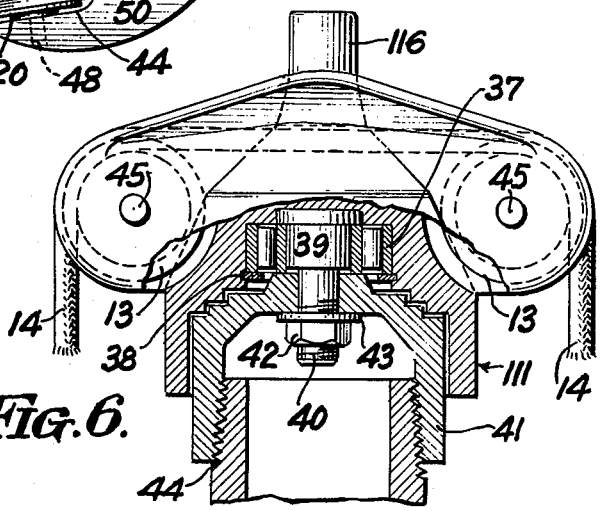
FIG. 6 is a cross-sectional view of the flagpole taken on line 6—6 of FIG. 4.
Figure 7:
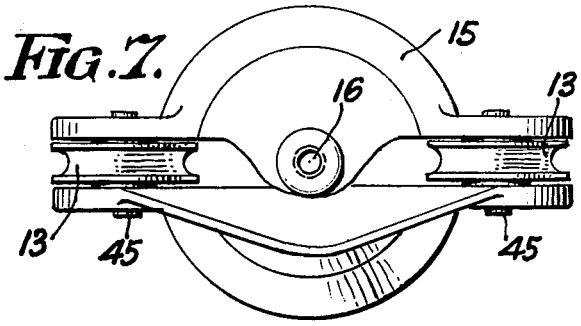
FIG. 7 is a top view of the embodiment of the flagpole shown in FIG. 6.

The embodiment of FIG. 8 is similar to FIG. 2 but the slot 118 between pin 115 and 116 is wider so that the rope 114 can slide freely into the slot.

The foregoing specification sets forth the invention in its preferred practical forms but the structure shown is capable of modification within a range of equivalents without departing from the invention which is to be understood is broadly novel as is commensurate with the appended claims.

I claim:

1. A remote threading flagpole comprising,
a pole,
a cap on the upper end of said pole,
a laterally extending slot in the top of said cap,
two horizontally spaced pulleys on said cap,
said slot being open at its top and disposed in said cap top tangentially to the top of said pulleys,
a rope having an intermediate part between its ends disposed in said slot passing around said pulleys and having its ends adapted to be attached to a flag,
a sleeve means slidably supported on the lower end of said flagpole,
at least one pulley on said sleeve means,
said rope passing around said pulley whereby the weight of said sleeve means exerts a downward force on said pulley holding said flag to said pole.

2. The flagpole recited in claim 1 wherein said cap is supported on said pole by means of a thrust bearing whereby said cap can rotate relative to said pole when said flag is blown by the wind.

3. The flagpole recited in claim 2 wherein weights are attached to said sleeve means said weights being adjustable to compensate for the force of a wind of a predetermined velocity.

4. The flagpole recited in claim 1 wherein at least two pulleys are supported on said sleeve means one said pulley having spaced holes therein and a hole extending through a flange on said sleeve means and into said hole in said pulley for locking said pulley in a predetermined position.

5. The flagpole recited in claim 4 wherein said bearing is supported on said cap threadably supported on the top of said flagpole.

6. The flagpole recited in claim 5 wherein a pin is supported in said cap forming a first guide member and said pin extends outwardly at approximately a 45° angle and defines one side of said slot, and a second guide member affixed to said cap and extending upwardly therefrom defining a guide for said rope for guiding said rope into said slot.

7. The flagpole recited in claim 6 wherein said slot is narrower than the space in said cap overlying said pulleys.

8. The flagpole recited in claim 7 wherein a stop member is supported on the lower end of said pole for moving into engagement with said sleeve means holding said sleeve means at a predetermined distance and providing slack on said rope.

9. The flagpole recited in claim 8 wherein said flagpole is swingably supported on said lower end of said pole whereby said flagpole can be lowered to service said cap.

10. The flagpole recited in claim 1 wherein one side of said slot is defined by an outwardly and upwardly inclined pin attached to said cap.

* * * * *